United States Patent [19]

Huck

[11] 4,222,187

[45] Sep. 16, 1980

[54] DISPLAY DEVICE

[76] Inventor: David N. Huck, R.D. 8, Box 262, Flemington, N.J. 08822

[21] Appl. No.: 11,381

[22] Filed: Feb. 12, 1979

[51] Int. Cl.[2] ..... G09F 3/10

[52] U.S. Cl. ..... 40/16; 40/124.4; 40/539; 40/594

[58] Field of Search ..... 40/538, 539, 124.1, 40/124.4, 584, 594, 610, 611, 10 R, 16 R, 16.2, 16.4, 154; 248/205 A, 459, 467, 472

[56] References Cited

U.S. PATENT DOCUMENTS

| | | | |
|---|---|---|---|
| 2,049,638 | 8/1936 | Bennett | 40/610 |
| 2,080,733 | 5/1937 | Mull | 40/124.1 |
| 2,632,269 | 3/1953 | Sanders | 40/594 |
| 2,923,078 | 2/1960 | Slavsky | 40/10 R |
| 3,077,686 | 2/1963 | Monalto | 40/16 |
| 3,176,419 | 4/1965 | Stein | 40/124.1 X |
| 3,180,607 | 4/1965 | Lee | 248/205 A |
| 3,624,688 | 11/1971 | Miller | 40/124.1 X |

*Primary Examiner*—John F. Pitrelli
*Assistant Examiner*—G. Lee Skillington
*Attorney, Agent, or Firm*—Omri M. Behr

[57] ABSTRACT

An advertising display device for use in supermarkets is adapted to catch the customer's eye by protruding slightly into the aisle and is affixed to the shelves used for storing goods thereon. The display device is fabricated from unitary sheet material, includes advertising indicia disposed thereon, and is inexpensive to manufacture.

11 Claims, 4 Drawing Figures

DISPLAY DEVICE

BACKGROUND OF THE INVENTION

1. Field of the Invention

The present invention relates to display devices, and more particularly, to an inexpensive disposable, display device adapted to have advertising literature disposed thereon and which can be readily affixed to supermarket shelves.

2. Description of the Prior Art

The prior art abounds with display devices, some of which are adaptable for use on supermarket shelves. Each attempts to catch the attention of customers so that they may be readily induced to read a message or observe indicia placed thereon. Many of these display devices are arranged so that they easily dispense the product being advertised. Other devices merely conveniently stack the product for a customer to view as he walks down the aisles in a supermarket.

Today, in accordance with laws presently in existence in many states, each product must be marked with a unit pricing value in some manner. Preferably, the shelf upon which the product is displayed, is marked with the price per unit e.g., per foot, per ounce, etc., which must be placed in clear view of the customer, on the forward facing edge of the shelf. Adjacent to the unit price is the actual price of the object to be sold. In order to prevent the pricing markers mounted on the forward facing edge of the shelf from being hidden from view, other mounting methods have been devised in order to attract the customer's attention. Some of these devices are suspended from the ceiling and appear in the vicinity of the product on the shelf. This approach is undesirable, since it creates an irregular and haggard appearance in the store and each of the aisles containing such a sign. Generally, the store itself utilizes a hanging sign to indicate the general type of products that are found on the shelves in a particular aisle. Free standing signs are undesirable, since they interfere with the shopping carts used to hold the products selected by the customer.

SUMMARY OF THE INVENTION

Thus, to overcome the shortcomings of the devices known in the prior art, a relatively small, inexpensive, disposable, display device for use on supermarket shelves has been developed. The instant invention is adapted to be affixed to supermarket shelves, extend into the aisles thereof, attract the attention of customers, not obstruct the pricing information found on the forward facing shelf edges and is flexible, so that when deflected by accident or purposefully by a customer it will not be destroyed.

Therefore, it is an object of the present invention to provide an inexpensive, disposable display device suitable for mounting on shelves.

It is a further object of the present invention to provide a display device which may readily attract the attention of a customer, be affixed to supermarket shelves and not obstruct the customer's view of the unit pricing information mounted on the forward facing edge of the shelf.

It is another object of the present invention to provide a disposable display device which may readily be mounted on a shelf and extend outwardly therefrom to catch the eye of a customer looking down the aisle.

It is yet another object of the present invention to provide an inexpensive display device which may be affixed to a shelf and is readily adapted to have indicia thereon replaced, if desired.

A display device for use on supermarket shelves, according to the principles of the present invention, comprises a flat unitary sheet material. The sheet material is provided with a first cut extending inwardly from an edge thereon and a second cut extending inwardly from an opposite edge thereon. The first and second cuts are coaxial, leaving an uncut portion and defining an elongated section partially severed from the material. The elongated section is divided into four parts by three score lines, disposed generally perpendicular to the longitudinal axis of the elongated section. The elongated section is bent along two of the three score lines in one direction and bent in the opposite direction along the remaining score line. An adhesive is disposed along the elongated section. The adhesive is utilized to bind the part including the uncut portion to a cooperating part of the elongated section. The remaining two parts having adhesive thereon are utilized for affixing the material to the shelf.

The subject matter which is regarded as the invention is particularly pointed out and distinctly claimed in the concluding portion of this specification. The invention, itself, however both as to its organization and its method of operation, together with further objects and advantages thereof may best be understood by reference to the following description taken in connection with the accompanying drawing.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
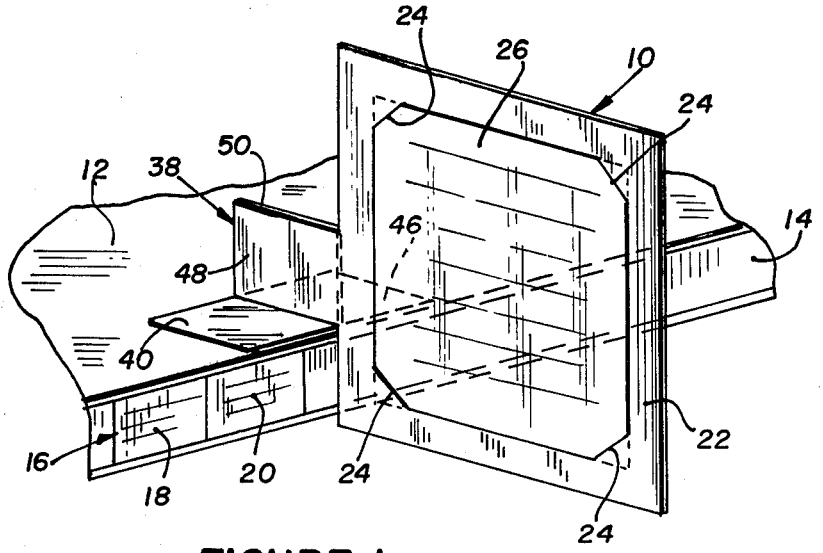
FIG. 1 is a pictorial representation of a display device, according to the principals of the instant invention, affixed to a shelf.

Referring now to the figures, and in particular to FIG. 1, which discloses a display device 10 affixed upon a shelf 12 normally found in a supermarket. The forward facing edge 14 of the shelf 12 has affixed thereon a pricing sticker 16 that is divided into two portions 18 and 20 which contain, respectfully, the unit pricing indicia thereon and the cost of the particular object mounted on the shelf thereabove. The pricing sticker is required to be visible to the customer at all times as he approaches the shelf to make his selection of an object mounted thereon. Thus, the need arises for a display device, such as that of the instant invention, which will catch the customer's eye as he is walking down the aisles in a supermarket, as well as, maintain the pricing sticker in clear view as he approaches the shelf.

The extending portion 22 of the display device may include indicia thereon such as printed slogans, prices, photographs, etc., adapted to attract the customer as he walks down the aisle. Pricing information such as for example, a special sale occuring on a particular day or week may also be indicated and appear on the extending portion 22 of display device 10.

Additionally, the extending portion 22 may be provided with a plurality of slits 24 which are placed diagonally proximate the edges thereof. If the material of the display device 10 is transparent then a card or paper 26 with indicia thereon may have its corners tucked into the slits 24 and held in position thereon. The card or paper 26 may be removed as desired when the sale is over or when different material is to be placed on the shelf.

Preferably, the display device is fabricated from paper or cardboard having sufficient weight and stiffness to allow it to stand in an upright position when mounted on the shelf 12. It may also be fabricated from a transparent material such as vinyl, celluloid or any other transparent material to create different effects or permit the insertion of a card 26 thereon. The material preferably, should be flexible so that a customer brushing against the sign, would not destroy it; instead, it should snap back into its normal position where it extends into the aisle. The cost of manufacturing this display device is minimal and the display device may be readily removed from the shelf and disposed of.

Figure 2:
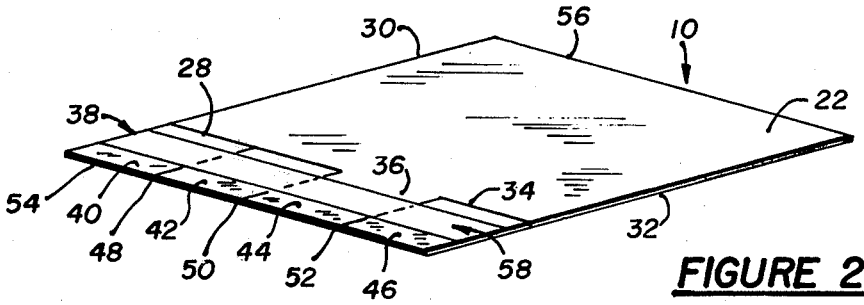
FIG. 2 is a perspective view of the sheet material utilized to make the display device shown in FIG. 1.
Figure 3:
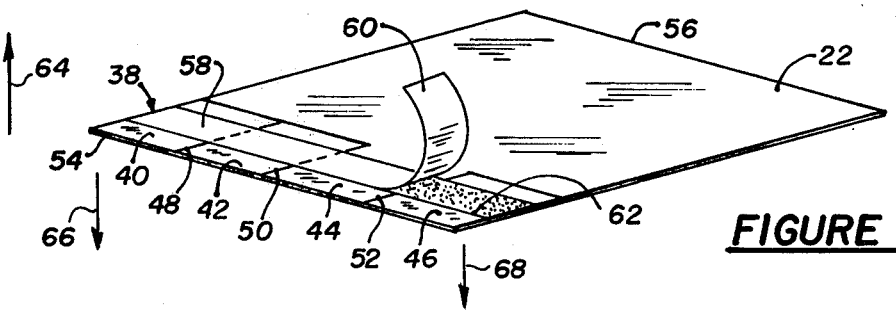
FIG. 3 is a pictorial representation of the display device with the covering of the adhesive partially removed.
Figure 4:
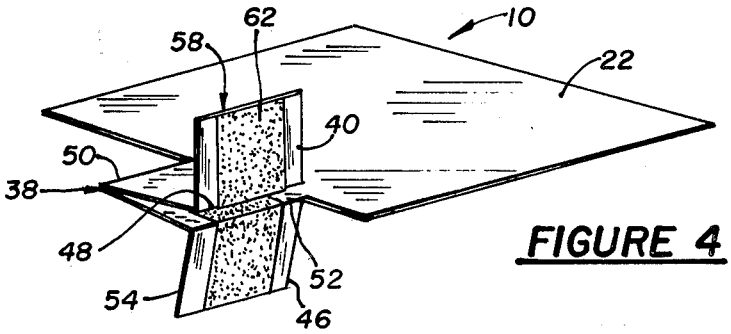
FIG. 4 is a pictorial representation in perspective of the display device folded and ready for affixing to a shelf.

The manner in which the display device 10 is fabricated, assembled, and made available for affixing to the shelf 12, is more clearly shown in FIGS. 2, 3, and 4. FIG. 2 is a perspective view of the display device 10 as it appears prior to assembly for installation on a shelf. The display device 10, is fabricated from a unitary sheet material preferably rectangularly shaped, although it may be fabricated in any other shape desired to create novel effects. A cut 28 extends inwardly from one edge 30 for approximately one-half the distance between edges 30 and 32. Another cut 34 extends inwardly from the opposite edge for a distance approximately equal to one-fourth of the distance between edges 30 and 32. Cuts 28 and 34 are coaxially aligned leaving a non-cut portion 36 defining an elongated section 38, which is partially severed from the extending portion 22 of the material. The elongated section 38 is divided into four equal parts by three score lines 28, 50 and 52 that divide the elongated section 38 into parts which are equal in length, width and to each other. Preferably, the elongated section is one-fourth the distance between edges 54 and 56, with the remaining area of material being in the extending portion 22 available for advertising indicia, which may be provided on both sides of the display device 10.

An adhesive means 58, which preferably is double sided adhesive tape, is applied along the longitudinal axis of the elongated section 38 extending from edge 30 to edge 32. A covering 60 is placed over the adhesive tape 58 during shipment or storage of the display device 10. Prior to mounting the display device on the shelf 12 the adhesive covering 60 is removed exposing the adhesive material 62.

In order to prepare the display 10 for installation on a shelf 12, parts 40 and 42 are simultaneously bent in the direction of arrow 64 along score line 50 until parts 42 and 44 cooperate with each other and are bound together by the adhesive 62 leaving parts 46 and 54 to be bent in the direction of arrows 66 and 68, which is opposite in direction to arrow 64. The parts 46 and 54 thus, extend outwardly from the plane of the extending protion 22 with the adhesive contact material 62 exposed and available for mounting the display device on to a shelf 12 as desired, as shown in FIG. 1.

Hereinbefore has been disclosed a display device which is inexpensive, disposable, and readily adaptable for mounting on supermarket shelves. This display device may contain an assortment of indicia to attract the attention of a consumer walking down the aisle. It will be understood that various changes in the details, materials, arrangement of parts and operating conditions which have been herein described and illustrated in order to explain the nature of the invention may be made by those skilled in the art within the prinicpals and scope of the present invention.

Having thus set forth the nature of the invention what is claimed is:

1. A display device for use on supermarket shelves, comprising flat unitary sheet material, said sheet material being provided with a first cut extending inwardly from an edge thereon and a second cut extending inwardly from an opposite edge thereon, said first and second cuts being coaxial, leaving an uncut portion, and defining an elongated section partially severed from said material, said elongated section being divided into four parts by three score lines disposed generally perpendicular to the longitudinal axis of said elongated section, said elongated section being bent along two of said three score lines in one direction and bent in the opposite direction along the remaining score line; and adhesive means disposed along said elongated section, said adhesive means binding the part including said uncut portion to a cooperating part of said elongated section, leaving two remaining parts with adhesive thereon for affixing said material to said shelf.

2. A display device according to claim 1, wherein said sheet material includes means for removably affixing advertising indicia thereon.

3. A display device according to claim 1, wherein said sheet material is transparent.

4. A display device according to claim 1, wherein said sheet material has advertising indicia printed directly thereon.

5. A display device according to claim 1, wherein said first cut extends inwardly for a distance equal to approximately ½ the distance between said edge and said opposite edge and said second cut extends inwardly approximately ¼th of the distance between said edges.

6. A display device according to claim 1, wherein said four parts are essentially equal in length, width and to each other.

7. A display device according to claim 1, wherein the bends along said score lines closest to said edges are in the same direction and the bend along said third score line is in the opposite direction.

8. A display device according to claim 1, wherein the width of said elongated section is approximately ¼th as wide as the width of said material.

9. A display device according to claim 1, wherein said adhesive means is double-sided tape disposed on one surface of said elongated portion.

10. A display device according to claim 1, wherein said two remaining parts extend outwardly in opposite directions when applied to said shelf.

11. A display device according to claim 1, wherein said material includes at least two slits disposed proximate the edges thereof for receiving the corners of a second piece of sheet material having indicia thereon.

* * * * *